US005752400A

United States Patent [19]

Kim

[11] Patent Number: 5,752,400

[45] Date of Patent: May 19, 1998

[54] UNIVERSAL LOCK AND KEY

[76] Inventor: Kwon W Kim, 1500 3rd Ave., #64, Chula Vista, Calif. 91911

[21] Appl. No.: 726,907

[22] Filed: Oct. 7, 1996

[51] Int. Cl.[6] ..... E05B 27/02

[52] U.S. Cl. ..... 70/368; 70/369; 70/371; 70/383; 70/411; 70/495

[58] Field of Search ..... 70/367–369, 382–385, 70/411, 495, 493, 371, 378, DIG. 2, DIG. 15

[56] References Cited

U.S. PATENT DOCUMENTS

| | | | |
|---|---|---|---|
| 2,370,862 | 3/1945 | Johnstone | 70/369 |
| 2,391,832 | 12/1945 | Johnstone | 70/367 |
| 4,377,940 | 3/1983 | Hucknall | 70/495 |
| 4,802,352 | 2/1989 | Andreoli | 70/379 R X |
| 5,211,044 | 5/1993 | Kim | 70/384 X |
| 5,325,690 | 7/1994 | Adler et al. | 70/383 |

FOREIGN PATENT DOCUMENTS

| | | | |
|---|---|---|---|
| 0006765 | 1/1980 | European Pat. Off. | 70/383 |
| 2055948 | 3/1981 | United Kingdom | 70/495 |

*Primary Examiner*—Lloyd A. Gall

[57] ABSTRACT

A universal lock and key assembly in which the lock is re-keyable and the key is also changeable. The key has an elongated left side member, an elongated right side member, and an elongated central member. A plurality of key teeth are captured between the shank portions of the left and right side members. The key teeth are interchangeable so that any desired sequence can be arranged to give a predetermined profile to the key. The universal lock has a combination top pin housing and tubular sleeve assembly having a top pin housing and a tubular sleeve portion. A bottom pin cylinder is removably received in the tubular sleeve portion and its bottom pins can be removed and replaced in an order that mates with the key teeth of the key assembly. The structure of the system allows an individual to change both the configuration of the key and also the mating structure within the lock so that it will be operable.

11 Claims, 5 Drawing Sheets

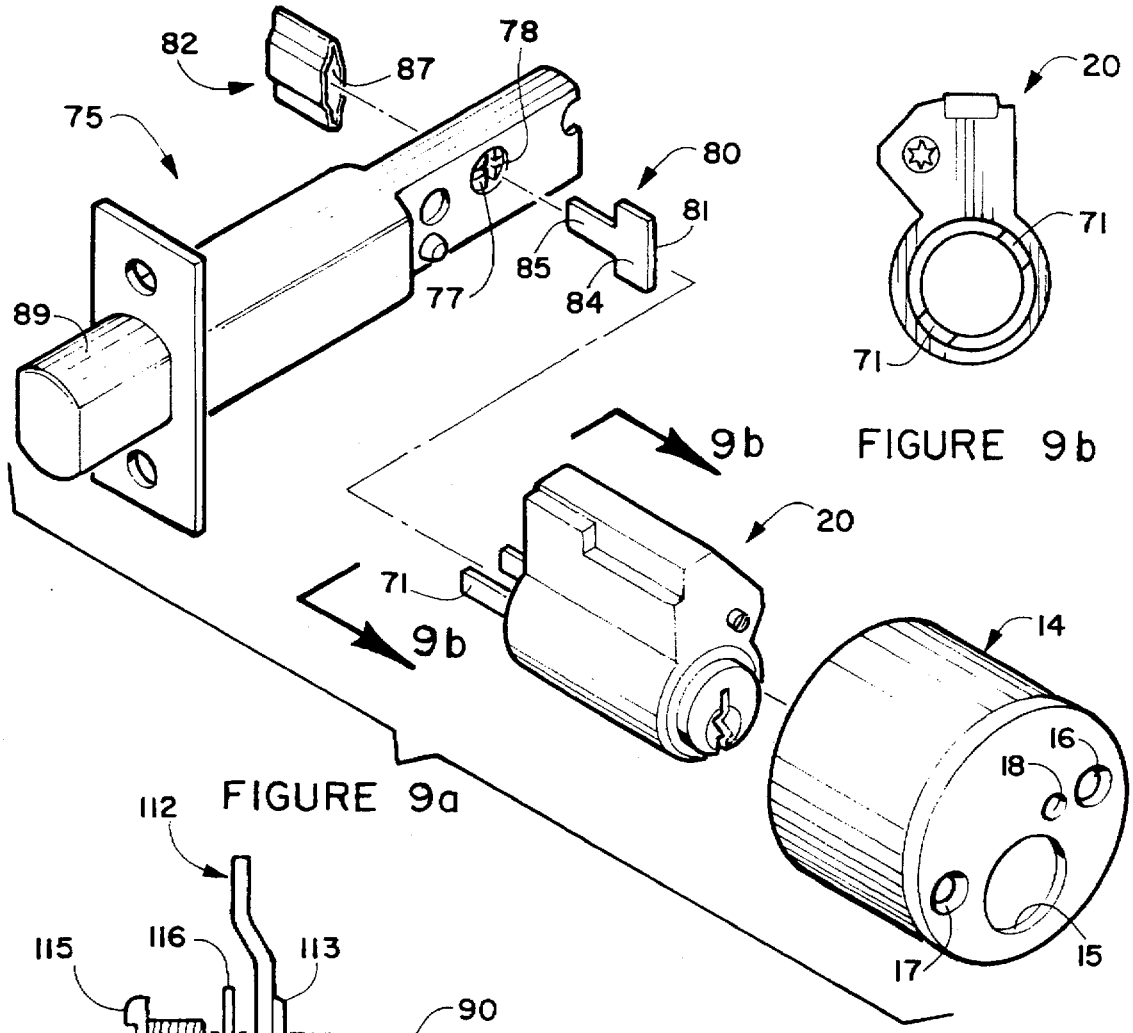
FIGURE 9a
FIGURE 9b
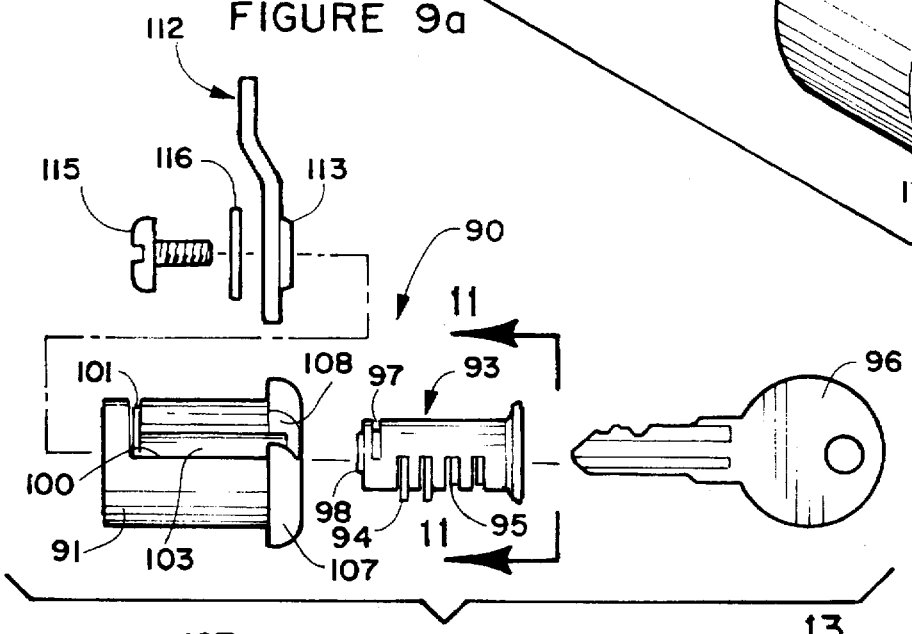
FIGURE 10
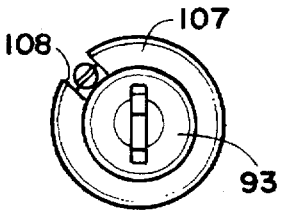
FIGURE 11
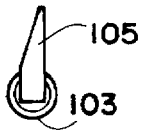
FIGURE 13
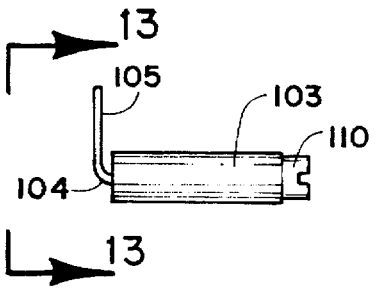
FIGURE 12

UNIVERSAL LOCK AND KEY

BACKGROUND OF THE INVENTION

The invention relates to a lock and more particularly to a tumbler cylinder lock that can be re-keyed to be opened by a key whose teeth can be arranged in a mating longitudinal sequence to open the lock. In the past most pin tumbler cylinder locks were not capable of being re-keyed. As a consequence, if a person lost his key, it was often necessary to replace the entire lock or require the services of a locksmith.

The Hori U.S. Pat. No. 3,431,757 is directed to a multiple key-lock having a change key mechanism. It is a conventional pin-type key operated lock having a locking needle originally positioned in a cavity in the shell adjacent the rotatable core locking certain inoperable pins, with the shell part thereof inoperable in the shell and free of blocking a remaining operable pin.

In more recent years, improved pin tumbler cylinder locks have been designed which allow a combination to be changed. The Burlingame U.S. Pat. No. 3,910,083 discloses a combination changing cylinder lock that allows the service key to be changed externally without access to the lock interior.

The Monahan U.S. Pat. No. 4,712,401 relates to a method of re-keying a pin tumbler cylinder lock having tumbler pins, driver pins and at least one master pin without disassembly of the lock apparatus for removal or replacement of any master pins therefrom.

The Shen U.S. Pat. No. 4,732,023 is directed to a modifiable cylinder. The primary object of the invention is to provide a modifiable cylinder in which the combination of pin tumblers in disks of the cylinder are changed by a designated key so that the original cylinder will become useless and a lock can be operated only by this designated key.

The Silvern U.S. Pat. No. 3,243,979 relates to an improved key that can be varied into configurations to fit different lock arrangements.

The Urrestarazu-Borda U.S. Pat. No. 4,545,226 is directed to a combination key that permits the opening of various locks with a single key.

The inventor, Mr. Kim, has U.S. Pat. No. 5,211,044 that is directed to a lock that is re-keyable and a key that is changeable. It uses a horizontally extending control sheet that extends horizontally into the top pin housing from its outer surface to lock the top pin in its top pin housing portion when the bottom pin cylinder is removed for re-keying the lock. This universal lock and key system has not been entirely satisfactory. As a result, Mr. Kim has improved the structure of his universal lock and key system.

It is an object of the invention to provide a novel lock and key assembly that has an improved key whose teeth are removable and re-arrangeable in various sequences.

It is also an object of the invention to provide a novel universal lock and key assembly that has improved structure for temporarily locking its top pins in its top pin housing portion while the bottom pin cylinder is removed.

It is another object of the invention to provide a novel universal lock and key assembly whose top pins and bottom pins have structure that make the lock un-pickable.

It is another object of the invention to provide a novel lock and key assembly that can be used with a dead bolt lock.

It is an additional object of the invention to provide a novel lock and key assembly that is economical to manufacture and market.

It is a further object of the invention to provide a novel lock and key assembly that can have the teeth of its key and the bottom pins of its bottom pin cylinder rearranged by an untrained do-it-yourselfer.

SUMMARY OF THE INVENTION

The universal lock and key system has been designed to have a key structure that is re-keyable and a lock structure that is re-keyable. An improved control sheet has been designed to capture the top pins in the top pin housing when the bottom pin cylinder is being removed to re-key the lock. The front end of the control sheet has a plurality of notches that engage annular grooves in the top pins when the control sheet moves to its inner most position in response to the turning of a gear pin that mates with gear teeth on the top surface of the control sheet. A pair of fingers extend an extra distance beyond the front edge of the control sheet so that when an improper key is used and the gear pin is rotated to move the control sheet inwardly only one of the top pins can be frictionally held at its present height. All of the other top pins will drop into their respective bore holes when the improper key is removed and therefore the bottom pin cylinder cannot be improperly turned or removed.

The top pins each have a head portion and a body portion that are separated by an outer annular groove. The diameter of the body portions is relieved adjacent their bottom ends to form tips of a reduced diameter that makes the lock un-pickable.

A release pin is inserted into a bore hole that makes an acute angle downwardly through the top pin housing portion into the interior of the tubular sleeve portion 24. The bottom end of the release pin seats in an annular groove adjacent the rear end of the bottom pin cylinder and prevents its removal. The release pin has gear teeth adjacent its outer surface that mate with gear teeth on the gear pin so that rotation of the gear pin will resolve in the release pin being lifted up out of the annular groove at the end of the bottom pin cylinder and allow its removal from the tubular sleeve portion. The locking pin also has a bore hole that makes an acute angle to the vertical plane and passes downwardly through the top pin housing portion into the interior of the tubular sleeve portion. The lock pin has a flat top surface against which a spring is mounted to continually try to force it downwardly. The outer surface of the lock pin has a flat recess below which is located an arcuate recess surface. Its bottom end is beveled. When the bottom pin cylinder has been removed from the tubular sleeve portion, the spring loaded lock pin is driven downwardly and it engages a flat surface on the gear pin to thereby prevent its rotation and thereby preventing movement of the control sheet laterally out of engagement with the top pins. This provides a fail safe structure to insure that the top pins do not drop downwardly out of their bore holes when the bottom pin cylinder has been removed.

The re-keyable key has a left side member, a central member and a right side member that are secured together by a screw and nut fastener. The shank of the left side member has a finger extending from its front end. This finger engages an aperture at the front end of the tip of the shank of the right side member. Captured between the respective shanks are a plurality of key teeth that may be arranged in any desired sequence to mate with the re-keyable lock.

The improved universal lock and key system can also be used with a conventional dead lock bolt assembly. An adapter assembly is interconnected with the standard actuation mechanism and its cross-shaped aperture in the deadbolt lock assembly. Fingers extending from the rear of the bottom pin cylinder engage a key of the adapter assembly and rotation of the bottom pin cylinder results in the deadbolt reciprocally traveling in and out of a striker plate.

The inventor has also designed a novel re-keyable cam lock such as would be used in a desk drawer or cabinet door. A rod having a screw driver slot in its front end is journaled in a sleeve in the cam lock assembly. The rear end of the rod has a finger extending laterally that is rotated into and out of a slot in the outer surface of the cam lock. When the finger is not engaged, the tubular lock cylinder can be removed for re-keying. The novel cam lock can have its lock re-keyed without requiring that its cam arm be removed.

DESCRIPTION OF THE DRAWINGS

FIG. 9*a* is an exploded front perspective view illustrating the universal lock in combination with a deadbolt assembly;

FIG. 9*b* is a rear elevation view taken along lines 9*b*—9*b* of FIG. 9*a;*

FIG. 10 is an exploded view of a re-keyably cam lock assembly;

FIG. 11 is a front elevation view of the cam lock assembly;

FIG. 12 is a top plan view of the rod and sleeve assembly;

FIG. 13 is a view taken along line 13—13 of FIG. 12;

DESCRIPTION OF THE PREFERRED EMBODIMENT

Figure 1:
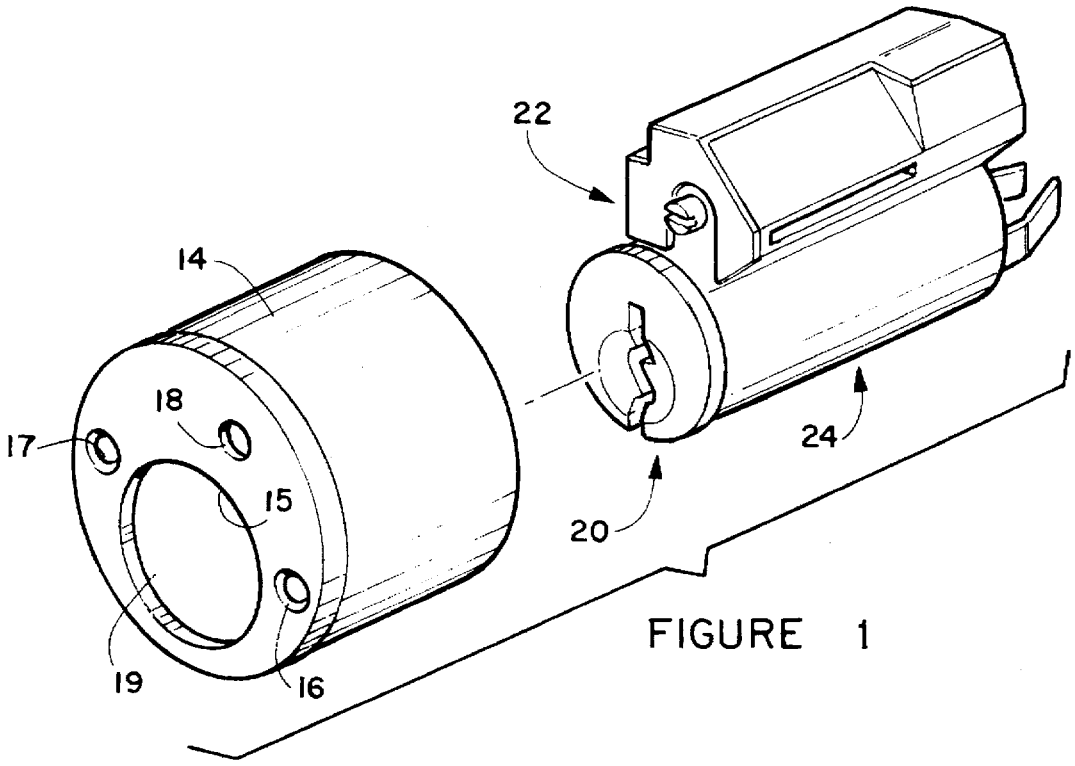
FIG. 1 is an exploded front perspective view of the lock housing and the combination top pin housing and tubular sleeve assembly.
Figure 2:
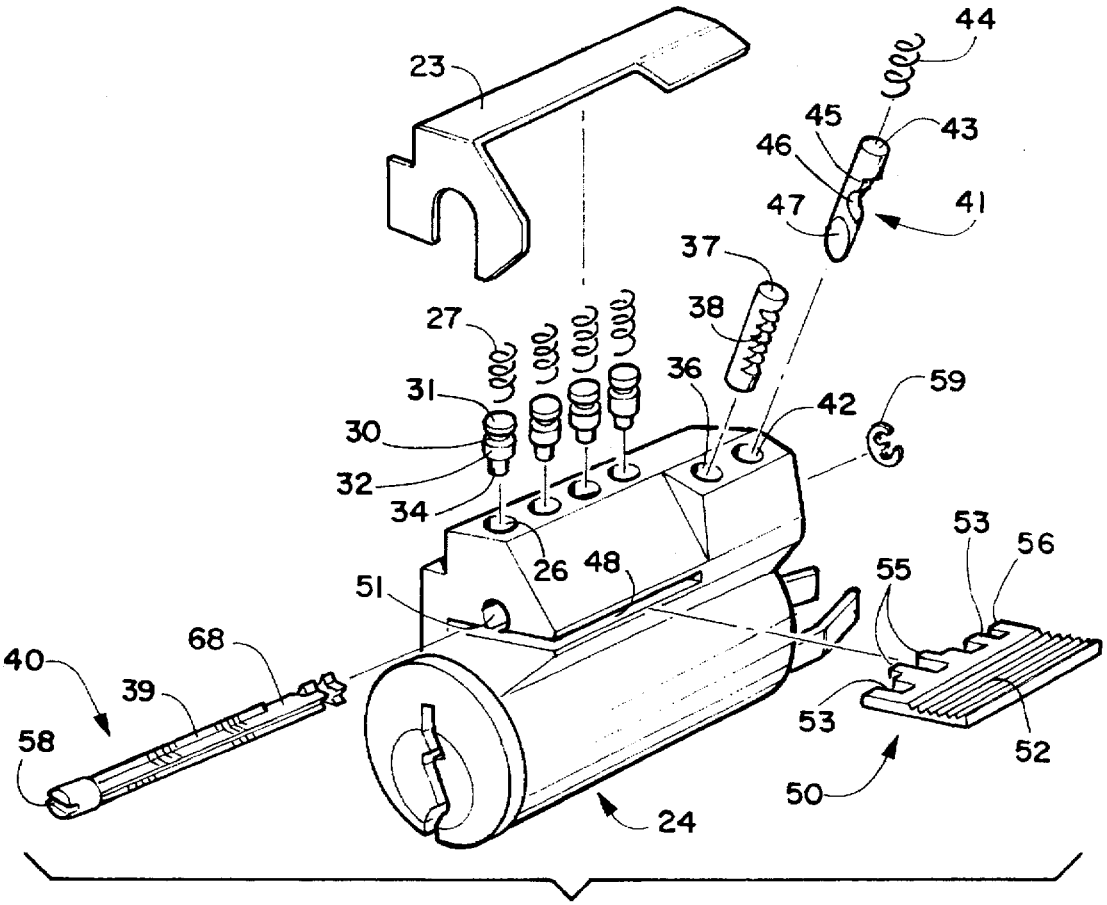
FIG. 2 is an exploded front perspective view of the combination top pin housing and tubular sleeve assembly.
Figure 3:
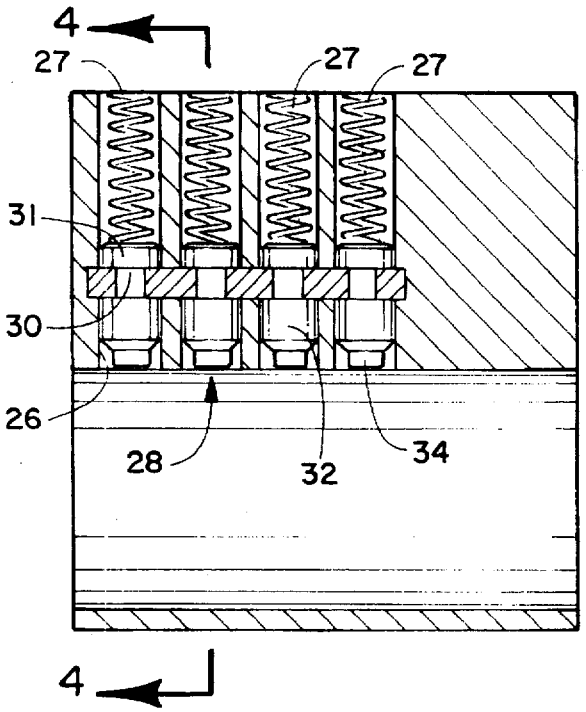
FIG. 3 is a cross sectional view taken along lines 3—3 of FIG. 4.
Figure 4:
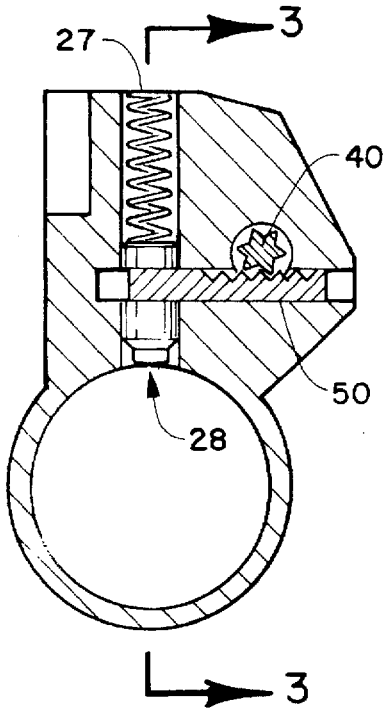
FIG. 4 is a cross sectional view taken along lines 4—4 of FIG. 3.
Figure 5:
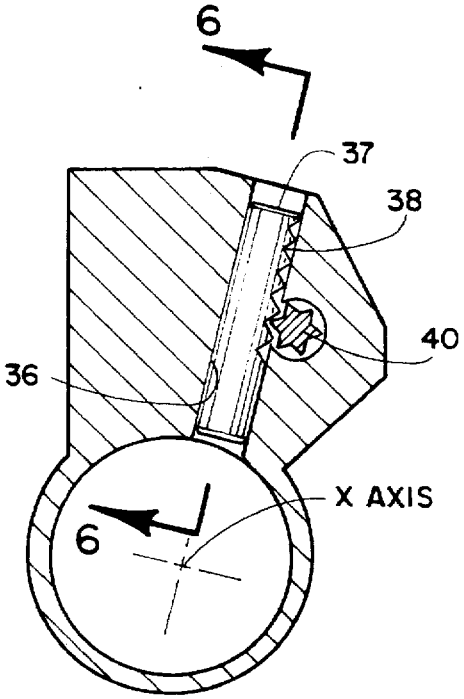
FIG. 5 is a cross sectional view showing the bore hole of the release pin.
Figure 6:
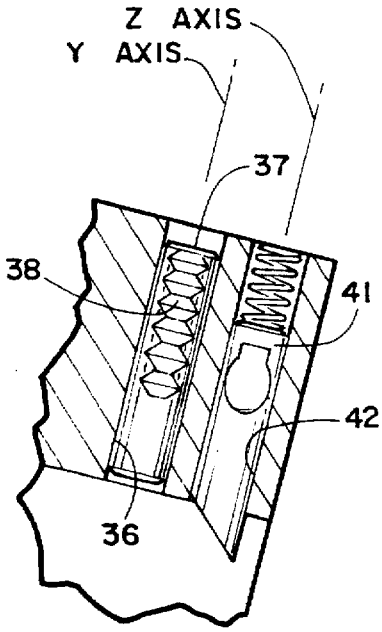
FIG. 6 is a cross sectional view taken along lines 6—6 of FIG. 5.
Figure 7:
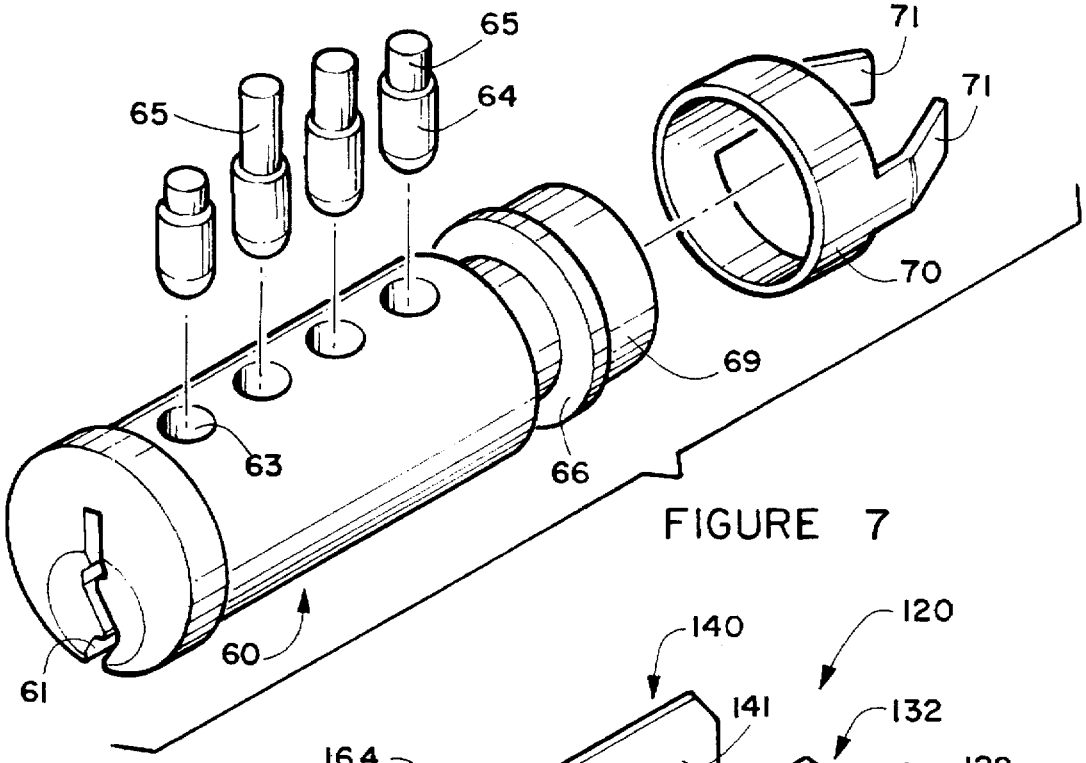
FIG. 7 is an exploded front perspective view of the bottom pin cylinder.

The novel universal lock and key system will now be described by referring to FIGS. 1–20 of the drawings.

The primary structure of the universal lock and key system is the combination top pin housing and tubular sleeve assembly 20. It is removably received in a tubular lock housing 14 that is often mounted in a door of a house. Tubular lock housing 14 has a major front aperture that receives the front end of the bottom pin cylinder 60. Apertures 16 and 17 are for screws(not shown) and aperture 18 receives the front end of elongated gear 40.

Combination top pin housing and tubular sleeve assembly 20 is best understood by referring to FIGS. 1–7. It has a top pin housing portion 22 and a tubular sleeve portion 24. A plurality of vertical bore holes 26 extend from the top end of top pin housing portion 22 to its bottom end. Springs 27 and top pins 28 are received within these vertical bore holes. Each top pin has an annular groove 30 that divide the pins into a head portion 31 and a body portion 32. The diameter of body portions 32 is relieved adjacent their bottom ends to form reduced diameter tips 34 that make the lock harder to pick. The top end of the vertical bore holes are covered by a removable cover 23.

Tubular sleeve portion 24 has a longitudinally extending X-axis. Bore holes 26 each have an axis that is vertical and they lie in a vertical plane that passes through the X-axis. Bore hole 36 has a Y-axis that makes an acute angle to the vertical plane that passes through the bore holes 26. Release pin 37 is inserted into bore hole 36 and it has gear teeth 38 adjacent its outer surface that mate with gear teeth 39 on gear pin 40. Bore hole 42 has a Z-axis and it is inclined at an acute angle that is parallel to the Y-axis. Lock pin 41 has a flat top surface 43 against which a spring 44 is positioned. The outer surface of lock pin 41 has a flat recess 45 below which is located an arcuate recess surface 46. The bottom end 47 is beveled.

A horizontally extending control sheet slot 48 is formed in one of the sides of top pin housing portion 22. A control sheet 50 is reciprocally mounted therein and it has longitudinally extending gear teeth 52 on its top surface that engage gear teeth 39 of gear pin 40. Lock pin 41 is normally in its upper position and at that time recess 46 allows gear teeth 39 to rotate freely within its curvature.

Control sheet 50 has a left edge having a plurality of notches 53 formed therein that engage the annular grooves 30 of all the top pins 28 when the proper key has been inserted into key slot 61 and when control sheet 50 travels to its extreme left position in response to the turning of gear pin 40. Fingers 55 extend an extra distance beyond left side edge 56. If no key is inserted into key slot 61 and someone is attempting to pick the lock, so that only one of the top pins 28 can be frictionally held at its present height (since the fingers would not be aligned with annular grooves 30) when control sheet 50 has been moved laterally to the left to engage top pins 28. If an improper key has been inserted into key slot 61 and gear pin 40 rotated clockwise only the top pin frictionally held by fingers 55 will not automatically drop downwardly into the bore holes 63 of bottom cylinder 60. All of the other top pins 28 will drop into their respective bore holes 63 when the improper key is removed and therefore bottom pin cylinder 60 cannot be improperly turned or removed.

Gear pin 40 passes through a horizontal bore hole 51 and its teeth 39 mesh with gear teeth 52 of control sheet 50. A screwdriver slot 58 is mounted on the front end of gear pin 40. An E-clamp spring 59 locks its rear end.

Bottom pin cylinder 60 has a key slot 61 formed in its bottom surface. A key stop in the rear of the bottom pin cylinder limits the distance that a key can be inserted into key slot 61. A plurality of apertures 63 extend downwardly from the top surface of bottom pin cylinder 60 and they are in communication with the top of key slot 61. Bottom pins 64 have different heights and they are assigned numbers that coordinate with numbers of the teeth of re-keyable key 120. The bottom pins have a relieved outer surface 65 adjacent their top ends and this also makes the lock un-pickable. An annular groove 66 is formed adjacent the rear end of bottom pin cylinder 60. The bottom end of release pin 37 normally rests in annular groove 66 and prevents the removal of bottom pin cylinder 60 from tubular sleeve portion 24. When gear 40 is rotated, gear teeth 38 on release pin 37 engage gear teeth 39 causing it to be lifted out of annular groove 66 and allows for the removal of bottom pin cylinder 60. When bottom pin cylinder 60 has been removed, spring 44 forces locking pin 41 downwardly and flat recess 45 engages flat relieved outer surface 68 on gear pin 40 and prevents it from being rotated. This prevents control sheet 50 from being retracted when bottom pin cylinder 60 has been removed.

The rear end of bottom pin cylinder 60 has a relieved outer surface that forms a cylindrical neck portion 69 that mates with an adapter collar 70 having a pair of laterally spaced rearwardly extending fingers 71. These fingers would engage a lock actuating mechanism such as that of a deadbolt lock.

In FIG. 9*a* and 9*b* the novel top pin housing and tubular sleeve assembly 20 is combined with a conventional deadbolt lock 75 having a standard actuation mechanism 77 having a cross-shaped aperture 78. Adaptor assembly 80 is comprised of a key 81 and a key receiving sleeve 82. Key 81 has a head 84 and a shank 85. Shank 85 is inserted into and through cross-shaped aperture 78. The front end of shank 85 is then captured in aperture 87 of key receiving sleeve 82. Fingers 71 straddle key 81 and rotation of the key in bottom pin cylinder 60 will cause deadbolt 89 to reciprocally travel in and out of a striker plate(not shown).

FIGS. 10–13 illustrate the novel re-keyable cam lock 90. It has a tubular lock housing 91 that removably receives a disc lock cylinder 93. A plurality of spring loaded discs 94 are captured in slots 95 and there are apertures in the discs 94 that conform to the key 96. Discs 94 may be interchanged and arranged in any sequence desired to re-key the lock. A transversely extending finger slot 97 is formed in the outer surface of disc lock cylinder 93 adjacent its rear end and a boss protrusion member 98, having a recess with a predetermined configuration, extends from its rear end. Tubular lock housing 91 has an axially extending groove 100 that communicates with a transversely extending slot 101 adjacent its rear end. A tubular sleeve 103 is mounted in groove 100. Rod 104 has a transversely extending locking finger 105 at its rear end and rod 104 is journaled in sleeve 103. Front plate 107 has an aperture 108 that receives the front end of sleeve 103 and screwdriver slot 110 is formed on the front end of rod 104. By rotating rod 104, finger 105 is rotated into slot 101 and then into slot 97. In this position disc lock cylinder 93 can not be removed from tubular lock housing 91. Cam arm 112 has a protrusion 113 extending from its front surface and it has a recess(not shown) having a configuration that mates with the protrusion 98 of flat disc lock cylinder 93. Cam arm 112 is secured to the rear end of tubular lock housing 91 by a screw 115 and washer 116. A rotation movement of key 96 in flat disc lock cylinder 90 therefore causes cam arm 112 to rotate from a locked position to an unlocked position.

Figure 8:
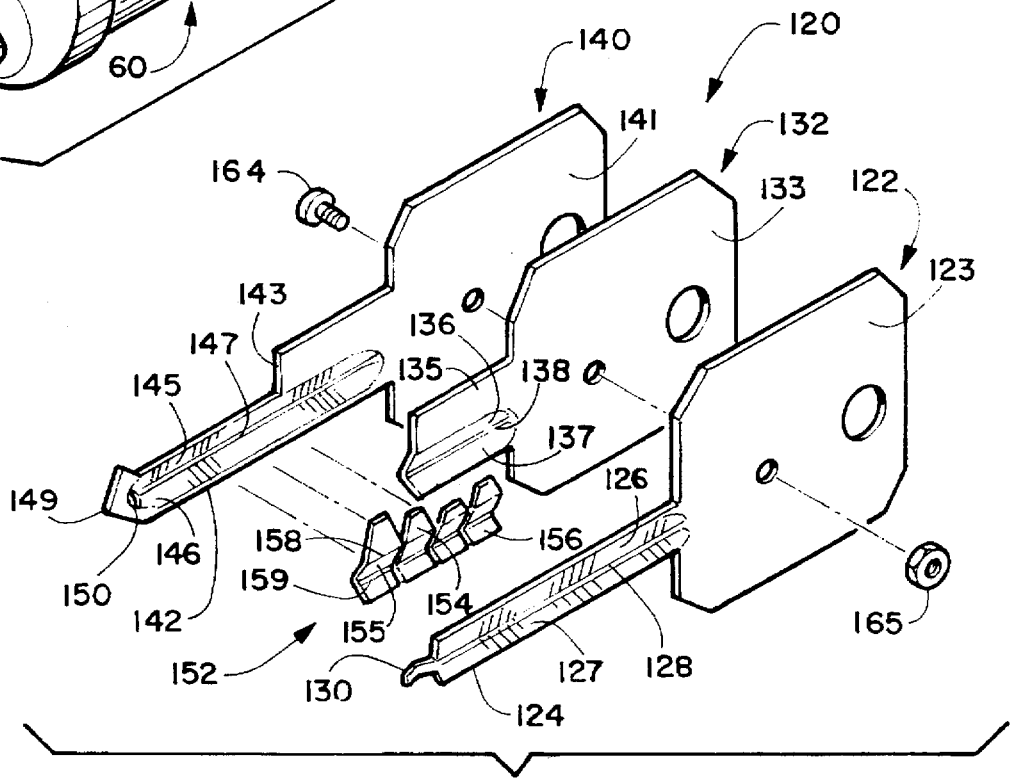
FIG. 8 is an exploded front perspective view of the re-keyably key.
Figure 14:
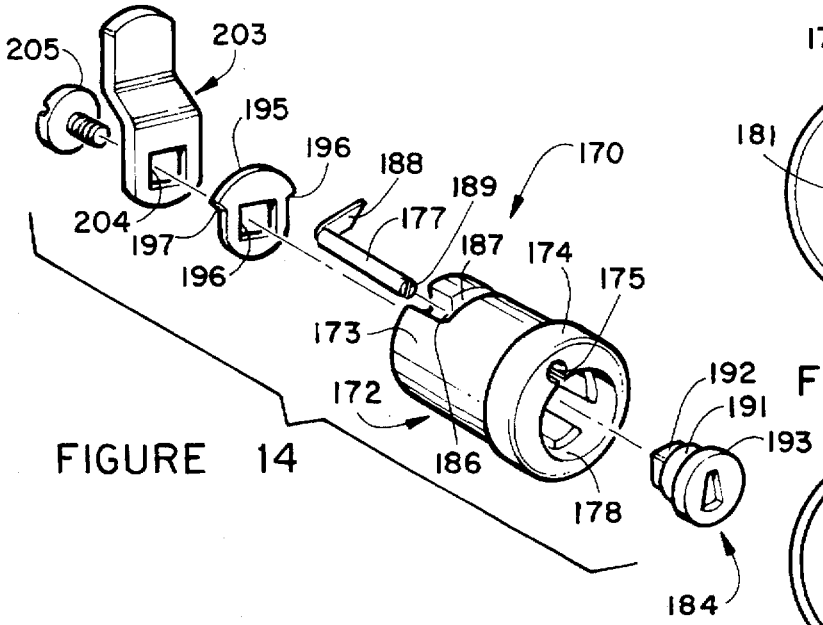
FIG. 14 is an exploded front perspective view of an alternative embodiment of the re-keyable cam lock assembly.

Re-keyable key 120 is illustrated in FIG. 8. It has a left side member 122 having a head 123 and a shank 124. Shank 124 has a top portion 126 and a bottom portion 127 that meet each other at a predetermined angle at bend line 128. The front end of shank 124 has a finger 130 extending forwardly therefrom.

Central member 132 has a head 133 and a shank 135. Shank 135 has a top portion 136 and a bottom portion 137 that meet each other at a predetermined angle at bend line 138.

Right side member 140 has a head 141 and a shank 142. A shoulder 143 extends upwardly from the top edge of shank 142. Shank 142 has a top portion 145 and a bottom portion 146 that meet each other at a predetermined angle at bend line 147. Shank 142 has a tip portion 149 at its front end and it has an aperture 150 for receiving finger 130. A plurality of key teeth 152 each have a top portion 154, a middle portion 155 and a bottom portion 156. These portions intersect their respective bend lines 158 and 159. A screw 164 and a nut 165 secure the respective members together. The key teeth may be arranged in any desired sequence to mate with the re-keyable lock.

Figure 15:
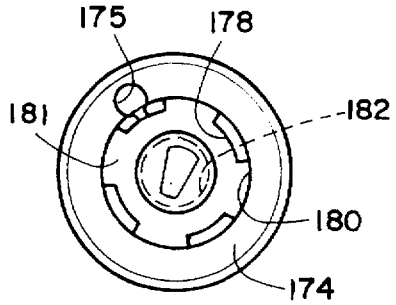
FIG. 15 is a front elevation view of its tubular lock housing.

An alternative embodiment of the re-keyable cam lock assembly 170 is illustrated in FIGS. 14–20. It has a tubular lock housing 172 having a cylindrical body 173 with a front annular collar 174. The front elevation view in FIG. 15 shows that it has a cylindrical bore hole 175 that passes through front annular collar 174 and a majority of the length of cylindrical body 173. Rod 177 is journaled therein. A plurality of inwardly extending internal ridges 178 are laterally spaced from each other to form internal channels 180 between adjacent internal ridges 178. Tubular lock housing 172 has a rear wall 181 having a bore hole 182 therein. A coupling 184 is inserted into bore hole 182 from the front end of tubular lock housing 172.

Figure 16:
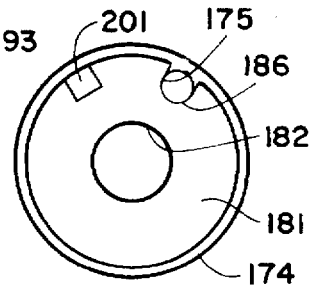
FIG. 16 is a rear elevation view of its tubular lock housing.
Figure 17:
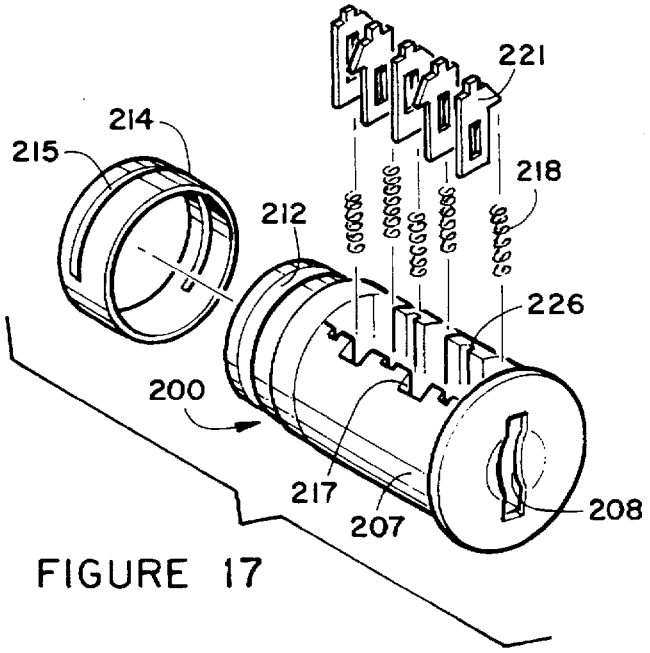
FIG. 17 is an exploded front perspective view of its tubular lock cylinder.

FIG. 16 shows the rear end of tubular lock housing 172 with coupling 184 removed. Longitudinally extending groove 186 intersects transverse slot 187. Longitudinal groove 186 allows rod 177 to be inserted into bore hole 175. Rod 177 has a finger 188 formed on its rear end that travels in and out of transverse slot 187 when a screwdriver is inserted into slot 189 at the front end of rod 177 and turned clockwise and counterclockwise. Coupling 184 has a cylindrical body portion 191 with a square protrusion 192 extending from its rear end. Its front end has an annular flange 193. Cylindrical body portion 191 passes through rear end bore hole 182 but annular flange 193 is too wide and nests against the inner surface of rear wall 181. A washer 195 has a square aperture 196 that matingly slides over square protrusion 192. Washer 195 also has a pair of shoulder stops 196 and 197 that when rotated by a key in disc lock cylinder 200 have their rotational travel stopped by a finger protrusion 201 extending from rear wall 181. Cam arm 203 has a square aperture 204 that also mates with square protrusion 192 and it is secured thereto by a screw 205 that is received in a threaded bore (not shown) in the rear end of square protrusion 192. It will thus be easily understood that rotation of the proper key in disc lock cylinder 200 will cause cam arm 203 to be rotated through 90 degrees which will unlock the cabinet doors or other structure in which the cam lock assembly is mounted. When disc lock cylinder 200 is removed for re-keying, coupling 184 remains connected to cam arm 203 by the respective structure of square protrusion 192 being inserted into square aperture 204.

Disc lock cylinder 200 has a cylindrical body 207 (see FIG. 17) with a keyhole slot 208 extending axially therein. It has a rear wall 210 having a protrusion 211 extending therefrom. An annular groove 212 has a cover ring 214 snapped thereon and it has a hemispherical slot 215 into which finger 188 on rod 177 may be rotated in order to lock disc lock cylinder 200 in tubular lock housing 172. When disc lock cylinder 200 is in a locked position, cover ring 214 will have been rotated to a position not aligned with hemispherical slot 215 and the un-slotted portion of cover ring 214 prevents finger 188 being rotated out of annular groove 212 and thereby prevents disc lock cylinder 200 from being removed from tubular lock housing 172. When disc lock cylinder 200 is in its unlocked position, hemispherical slot 215 will be positioned above finger 188 thereby allowing finger 188 to be rotated out of annular groove 212 by turning a screwdriver whose blade is inserted into screwdriver slot 189. Disc lock cylinder 200 can then be removed from tubular lock housing 172 for changing the sequence of discs 221 and thereby re-keying the lock.

A plurality of spring bore holes 217 extend downwardly into the top surface of cylindrical body 207 and springs 218 are removably received therein. Each of the bore holes 217 mates with a transversely extending slot 220 that removably receives a disc 221. The springs have their top ends captured by fingers 223 on the respective discs 221. The front end of cylindrical body 207 has an annular flange 224 that in its assembled state rests against the front ends of the respective internal ridges 178. Slots 220 pass through the bottom surface of cylindrical body 207 so that when a key is inserted in keyhole slot 208, the respective discs 221 have their top edges 226 pulled downwardly so that they extend from the bottom ends of these respective slots. Prior to insertion of a key in keyhole slot 208, the respective discs 221 are maintained in an upward position that extends into one of the internal channels of tubular lock housing 172 to thereby prevent rotation of disc lock cylinder 200.

Figure 20:
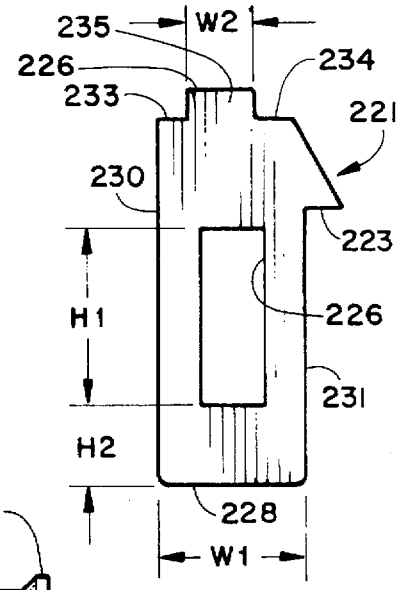
FIG. 20 is a front elevation view of one of the discs utilized in the tubular lock cylinder.
Figure 18:
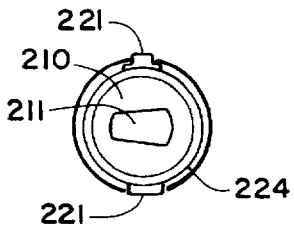
FIG. 18 is a rear elevation view of the tubular lock cylinder.
Figure 19:
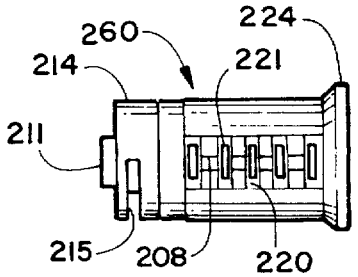
FIG. 19 is a bottom plan view of the tubular lock cylinder.

In FIG. 20, one of the discs 221 is illustrated in a front elevation view. It has a slot 226 through which the key passes upon insertion. The slots 226 have a height H1 and its bottom edge is a height H2 above the bottom edge 228 of disc 221. The height H2 would be varied on the individual disc members and coordinated with the height of the teeth on a key. Disc 221 has a left side edge 230 and a right side edge 231 and a width W1. The top edge 226 has been relieved adjacent each of the respective left and right side edges to form shoulders 233 and 234 and form an upwardly extending neck portion 235. Neck portion 235 has a width W2 and this structure makes the lock unpickable.

What is claimed is:

1. A universal lock and key system in which the lock is re-keyable and the key is re-keyable comprising:

a combination top pin housing and tubular sleeve assembly having a top pin housing portion and a tubular sleeve portion and they each have a front end and a rear end;

said top pin housing portion having a longitudinal axis, a top end and a bottom end; a plurality of top pin bore holes are formed in said top pin housing portion and they extend upwardly from its bottom end, said top pin bore holes each having an axis and said axes are aligned in a vertical plane that passes through said longitudinal axis, a top pin and spring removably received in at least most of said bore holes; said top pins having a top end and a bottom end; an annular groove is formed in said top pins at a predetermined position between said top end and said bottom end to form a vertically spaced head portion and body portion on said top pins;

means for locking said top pins in said top pin housing portion comprising a longitudinally extending control sheet slot that extends horizontally into said top pin housing portion from its outer surface to said top pin bore holes; a control sheet having a front end, a left side edge, a right side edge, a rear end, a top surface and a bottom surface; one of the side edges of said control sheet having a plurality of longitudinally spaced notches whose width is sufficient to enable said notches to engage the annular grooves on the said respective top pins; said control sheet having gear teeth on at least one of either said top surface or said bottom surface; a horizontal bore hole formed in said top pin housing portion in communication with said control sheet slot; an elongated gear pin having a front end, a rear end, and teeth extending substantially along the length of said gear pin; said gear pin being received in said horizontal bore hole with said teeth of said gear pin being in engagement with said gear teeth on said control sheet; said control sheet being movable in and out of said control sheet slot from a position where it engages said top pins to a position where said top pins are disengaged;

said tubular sleeve portion being formed on the bottom end of said top pin housing portion and said tubular sleeve portion having a longitudinal X-axis, said bore holes of said top pin housing portion being in communication with the interior of said tubular sleeve portion; said vertical plane of said axes of said top pin bore holes passes through said X-axis of said tubular sleeve portion;

a secondary bore hole having a Z-axis is formed in said top pin housing portion adjacent said rear end; said secondary bore hole has a top end and a bottom end; said Z-axis of said secondary bore hole makes an acute angle to said vertical plane that passes through said X-axis of said tubular sleeve portion; an elongated lock pin having a top end, a bottom end and an intermediate portion is reciprocally positioned in said secondary bore hole; a spring is positioned in said secondary bore hole against the top end of said lock pin and said spring provides downward force against said lock pin; said horizontal bore hole in said top pin housing portion being in communication with said secondary bore hole; said gear pin having a flat relieved outer surface adjacent said rear end of said gear pin; said lock pin having a flat recess on the outer surface of said intermediate portion of said lock pin; when a bottom pin cylinder has been removed from said tubular sleeve portion, said spring forces said lock pin downwardly and said flat recess on said lock pin engages said flat relieved outer surface of said gear pin and prevents said gear pin from being rotated thereby preventing said control sheet from being retracted and thereby preventing said top pins from dropping out of the bottom of said top pin housing portion when said bottom pin cylinder has been removed to re-key said universal lock;

a bottom pin cylinder having a longitudinal axis, a front end, a rear end, a top surface and a bottom surface; a key slot extends longitudinally a predetermined distance into said bottom pin cylinder from its front end, a plurality of longitudinally aligned bottom pin bore holes extend from said top surface into said key slot, a plurality of bottom pins are removably mounted in said bottom pin bore holes; and said bottom pin cylinder being removably mounted in said tubular sleeve portion.

2. A universal lock and key system as recited in claim 1 further comprising means for locking said bottom pin cylinder in said tubular sleeve portion.

3. A universal lock and key system as recited in claim 1 further comprising means on the rear end of said bottom pin cylinder for unlatching a locking mechanism.

4. A universal lock and key system as recited in claim 1 wherein said top pin bore holes extend upwardly to the top end of said top pin housing portion and a removable cover is secured thereto.

5. A universal lock and key system as recited in claim 1 further comprising a key having removable teeth that can be arranged in different sequences to conform to mating bottom pins having different heights.

6. A universal lock and key system as recited in claim 1 wherein the bottom ends of said top pins have a diameter that is reduced from the diameter of the body portion of said respective top pins thereby making said universal lock harder to pick.

7. A universal lock and key system as recited in claim 1 further comprising said bottom pin cylinder having an annular groove positioned at a predetermined location on its outer surface for removably receiving the bottom end of a release pin.

8. A universal lock and key system as recited in claim 7 further comprising a locking bore hole extending upwardly from the bottom end of said top pin housing portion and a locking pin removably captured therein.

9. A universal lock and key system as recited in claim 1 in combination with a conventional deadbolt lock having an actuating mechanism that is removably connected to means on the rear end of said bottom pin cylinder for locking and unlocking said deadbolt lock.

10. A universal lock and key system as recited in claim 1 wherein said bottom pins have top ends having a reduced diameter thereby making said universal lock harder to pick.

11. A universal lock and key system in which the lock is re-keyable and the key is re-keyable comprising:

a combination top pin housing and tubular sleeve assembly having a top pin housing portion and a tubular sleeve portion and they each have a front end and a rear end;

said top pin housing portion having a longitudinal axis, a top end and a bottom end, a plurality of top pin bore holes are formed in said top pin housing portion and they extend upwardly from its bottom end, said top pin bore holes being aligned with said longitudinal axis, a top pin and spring removably received in at least most of said bore holes; said top pins having a top end and a bottom end; an annular groove is formed in said top pins at a predetermined position between said top end and said bottom end to form a vertically spaced head portion and body portion on said top pins;

means for locking said top pins in said top pin housing portion comprising a longitudinally extending control sheet slot that extends horizontally into said top pin housing portion from its outer surface to said top pin bore holes; a control sheet having a front end, a left side edge, a right side edge and a rear end; one of the side edges of said control sheet having a plurality of longitudinally spaced notches whose width is sufficient to enable said notches to engage the annular grooves on the respective top pins; said control sheet being movable in and out of said control sheet slot from a position where it engages said top pins to a position where said top pins are disengaged;

said side edge of said control sheet that has said notches also having a pair of fingers extending an extra distance beyond said side edge; said pair of fingers being laterally spaced from each other a distance equal to the width of one of said notches that said fingers would straddle so that the notch between said fingers can engage the annular groove on one of said top pins when said control sheet travels into said control sheet slot; said fingers act as a deterrent to said universal lock being picked by a wire or pick-type tool since rotation of a gear pin without a proper key in said lock will only allow one of said top pins to be frictionally held at its present height when said control sheet has been moved laterally to engage said top pins, thus making it harder to use a wire or pick-type tool;

said tubular sleeve portion being formed on the bottom end of said top pin housing portion and they have aligned longitudinal axes, said bore holes of said top pin housing portion being in communication with the interior of said tubular sleeve portion;

a bottom pin cylinder having a longitudinal axis, a front end, a rear end, a top surface and a bottom surface; a key slot extends longitudinally a predetermined distance into said bottom pin cylinder from its front end, a plurality of longitudinally aligned bottom pin bore holes extend from said top surface into said key slot, a plurality of bottom pins are removably mounted in said bottom pin bore holes; and said bottom pin cylinder being removably mounted in said tubular sleeve portion.

* * * * *